United States Patent [19]

Diehl et al.

[11] Patent Number: 4,948,717

[45] Date of Patent: Aug. 14, 1990

[54] SOLID PARTICLE DYE DISPERSIONS FOR PHOTOGRAPHIC FILTER LAYERS

[75] Inventors: Donald R. Diehl; Ronda E. Factor, both of Rochester, N.Y.

[73] Assignee: Eastman Kodak Company, Rochester, N.J.

[21] Appl. No.: 373,747

[22] Filed: Jun. 30, 1989

Related U.S. Application Data

[63] Continuation-in-part of Ser. No. 137,490, Dec. 23, 1987, Pat. No. 4,857,446, which is a continuation-in-part of Ser. No. 104,468, Oct. 5, 1987, abandoned, which is a continuation-in-part of Ser. No. 945,634, Dec. 23, 1986, abandoned.

[51] Int. Cl.[5] ..... G03C 1/84

[52] U.S. Cl. ..... 430/510; 430/507; 430/512; 430/517; 430/522; 430/553; 430/555

[58] Field of Search ..... 430/510, 512, 517, 507, 430/522, 553, 555

[56] References Cited

U.S. PATENT DOCUMENTS

| | | | |
|---|---|---|---|
| 3,445,231 | 5/1969 | Nishio et al. | 430/522 |
| 3,481,927 | 12/1969 | Heseltine et al. | 430/522 |
| 3,560,214 | 2/1977 | Ruda | 96/84 |
| 3,563,748 | 2/1971 | Depoorter et al. | 430/522 |
| 3,984,247 | 10/1976 | Nakamura et al. | 430/522 |
| 4,092,168 | 5/1978 | Lemahieu et al. | 252/300 |
| 4,294,916 | 10/1981 | Postle et al. | 430/522 |
| 4,294,917 | 10/1981 | Postle et al. | 430/522 |
| 4,311,787 | 1/1982 | Lemahiev et al. | 430/522 |
| 4,420,555 | 12/1986 | Kreuger et al. | 430/507 |
| 4,587,195 | 5/1986 | Ishikawa et al. | 430/139 |
| 4,857,446 | 8/1989 | Diehl et al. | 430/510 |

FOREIGN PATENT DOCUMENTS

| | | |
|---|---|---|
| 0109555 | 5/1974 | German Democratic Rep. . |
| 135936 | 3/1960 | Japan . |
| 1395779 | 12/1972 | United Kingdom . |
| 2138961 | 4/1975 | United Kingdom . |
| 2032636 | 8/1979 | United Kingdom . |

OTHER PUBLICATIONS

Research Disclosure, Item 14416, Apr. 1976.

Hamer, The Cyanine Dyes and Related Compounds; pp. 463–485, 1964.

Research Disclosure 14416, Light-Absorbing Dyes for Photographic Elements, Apr. 1976, pp. 17–20.

Palmer, The Structure and Reactions of Heterocyclic Compounds, 1967; pp. 377 and 383–384.

Elderfield, Heterocyclic Compounds, vol. 5, 1957; pp. 413, 415 and 416.

*Primary Examiner*—Jack P. Brammer

*Attorney, Agent, or Firm*—Paul L. Marshall

[57] ABSTRACT

Dyes having the structure

A represents a substituted or unsubstituted nucleus selected from the group consisting of rhodanines, hydantoins, 2-thiohydantions, 4-thiohydantoins, 2,4-oxazolidindiones, 2-thio-2,4-oxazolidindiones, isoxazolinones, barbiturics, 2-thiobarbiturics, and indandiones, said nucleus having a carboxyphenyl substituent or sulfonamidophenyl substituent, R represents hydrogen, alkyl of 1 to 4 carbon atoms, or benzyl, $R^1$ and $R^2$ each independently represents alkyl or aryl, or taken together with $R^5$, $R^6$, N, and the carbon atoms to which they are attached represent the atoms needed to complete a julolydyl ring, $R^3$ represents H, alkyl, or aryl, $R^5$ and $R^6$ each independently represents H, or $R^5$ taken together with $R^1$, or $R^6$ taken together with $R^2$, each may represent the atoms necessary to complete a carbocyclic ring, and m is 0 or 1 are disclosed. The dyes are useful as filter dyes in photographic filter layers.

9 Claims, No Drawings

SOLID PARTICLE DYE DISPERSIONS FOR PHOTOGRAPHIC FILTER LAYERS

This application is a continuation-in-part of application No. 07/137,490 filed 12-23-87, now U.S. Pat. No. 4,857,446, which is a continuation-in-part of application No. 07/104,468, filed on 10-5-87, now abandoned, which is a continuation-in-part of application No. 06/945,634, filed 12-23-86, now abandoned.

FIELD OF THE INVENTION

This invention relates to filter dyes and their use in photographic elements.

BACKGROUND OF THE INVENTION

Filter dyes are widely used in photographic elements. Filter dyes may be located in several locations in an element. They may be in a radiation-sensitive layer, an overcoat layer, in a layer adjacent to the radiation-sensitive layer, in an interlayer of a multilayer element, in an undercoat layer adjacent to the support or in a backing layer on the side of the support opposite the radiation-sensitive layer.

When incorporated directly in the radiation-sensitive layer they can function to improve sharpness by absorbing light scattered from one silver halide grain to another. Such dyes are referred to as absorber dyes. Filter dyes also function to retard the sensitivity of one light sensitive layer relative to another in a multilayer element. By absorbing some of the exposing radiation the filter dye aids in balancing the sensitivities of all the light sensitive layers.

Filter dyes that function primarily to absorb unwanted radiation due to reflection or refraction from layer interfaces, the layer-support interface, and particularly from the back side of the support, are referred to as antihalation dyes. The layers that contain them are referred to as antihalation layers.

There are other places and purposes for filter dyes and filter layers. For example, a filter layer may be used in or near the overcoat layer to protect the light sensitive layer against radiation from certain spectral regions. In multilayer films where there may be two or more light sensitive layers, it is sometimes necessary to have filter dye interlayers. In duplitized ® materials, such as X-ray films, filter layers are used to reduce crossover exposure of the light sensitive layers. Elimination of crossover exposure is an ideal that is highly desirable but has not yet been fully attained.

A number of problems are associated with filter dyes and filter layers. It is very important that the dyes remain in the layer and not wander or diffuse into the adjacent layers. This often necessitates the presence of a mordant to hold the dye in the layer. It is equally important for the dyes to be completely decolorized and/or removed from the element, usually during processing, after they have performed their function. Dye stability, especially under high temperature and high humidity incubation is also important.

In some photographic elements, it is desirable to absorb unwanted radiation across the entire visible spectrum. In such elements it is not unusual to use up to five filter dyes in a single filter layer to accomplish this desirable objective. Clearly it would be an improvement to reduce the number of filter dyes used in the layers of such elements.

U.S. Pat. No. 3,560,214 discloses dyes comprising a carboxyl and phenyl substituted pyrazoline nucleus linked through a methine group to a dialkylaminophenyl group. However these dyes, according to the patent and our own experiments, are migratory.

It is an objective of this invention to provide filter dyes for photographic elements which meet the foregoing requirements for filter dyes, do not cause post process dye stain or migrate from layer to layer and reduce the number of filter dyes needed in a filter layer.

SUMMARY OF THE INVENTION

The foregoing objectives are achieved with a dye having the formula:

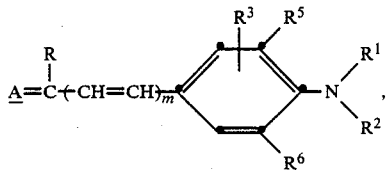

I wherein

A represents a substituted or unsubstituted nucleus selected from the group consisting of rhodanines, hydantoins, 2-thiohydantions, 4-thiohydantoins, 2,4-oxazolidindiones, 2-thio-2,4-oxazolidindiones, isoxazolinones, barbiturics, 2-thiobarbiturics, and indandiones, said nucleus having a carboxyphenyl substituent or sulfonamidophenyl substituent.

R represents hydrogen, alkyl of 1 to 4 carbon atoms or benzyl, $R^1$ and $R^2$, each independently, represents alkyl or aryl, or taken together with $R^5$, $R^6$, N and the carbon atoms to which they are attached represent the atoms needed to complete a julolydyl ring, $R^3$ represents H, alkyl or aryl, $R^5$ and $R^6$, each independently, represents H, or $R^5$ taken together with $R^1$, or $R^6$ taken together with $R^2$ may represent the atoms necessary to complete a carbocyclic ring such as tetrahydroquinoyl, and m is 0 or 1.

According to formula (I), A is a substituted or unsubstituted nucleus selected from the group consisting of rhodanines, hydantoins, 2-thiohydantoins, 4-thiohydantions, 2,4-oxazolidindiones, 2-thio-2,4-oxazolidindiones, isoxazolinones, barbiturics, 2-thiobarbiturics, and indandiones, said nucleus having a carboxyphenyl substituent or sulfonamidophenyl substituent. The nuclei useful as A are all ketomethylene nuclei having positions on which it is synthetically feasible to place the carboxy- or sulfonamido-bearing phenyl substituents as required by the invention.

In a preferred embodiment, the dyes of the invention are merostyryl indandione arylidenes having the formula:

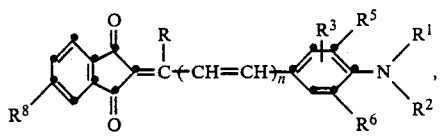

(II)

wherein

R represents hydrogen, alkyl of 1 to 4 carbon atoms or benzyl, $R^1$ and $R^2$, each independently, represents alkyl or aryl, or taken together with $R^5$, $R^6$, N and the carbon atoms to whatever they are attached represent the atoms needed to complete a julolydyl ring, $R^3$ represents H, alkyl, aryl, alkoxy, hydrogen or acetamido, $R^4$ represents alkyl, alkoxycarbonyl, aryl, acyl and amido, $R^5$ and $R^6$ each independently represents H, or $R^5$ taken together with $R^1$, or $R^6$ taken together with $R^2$ represent the atoms necessary to complete a carbocyclic ring, $R^8$ represents $CO_2H$ or $NHSO_2R^9$ wherein $R^9$ is substituted or unsubstituted alkyl or aryl, and n is 0 or 1.

Solid particle dispersion of the dyes of this invention leave no residual post-processing stain in processed photographic elements. Polymeric mordants are not needed to immobilize the dyes. Complete immobilization is achieved without mordants. Complete and irreversible dye removal during processing is achieved. Broadened and shifted absorption is obtained, which makes the compositions particularly suitable for filter or antihalation applications. Their broadened absorption bands are particularly useful in reducing the number of dyes needed in a single element to absorb unwanted radiation. Another advantage is superior dye stability when subjected to high temperature and high humidity incubation.

DESCRIPTION OF THE PREFERRED EMBODIMENTS

The acyl, alkyl and alkoxy groups may contain from one to twenty carbons. Examples of such groups include acetyl, benzoyl, methyl, ethyl, propyl, methoxy carboxyl, ethoxy carboxyl, butoxycarboxyl, fluoroalkyl, dodecyl, octadecyl. The aryl groups may contain from six to twenty carbons which may be further substituted with a wide variety of groups. Examples of such substituted and unsubstituted aryl groups include phenyl and napthyl with alkyl substituents as defined above.

The carboxylphenyl or sulfonamidophenyl substituent on A in formula (I) and $R^8$ in formula (II) is important in immobilizing the dye at coating pH's of 7 or below.

Useful dyes according to formulas (I) and (II) include the following:

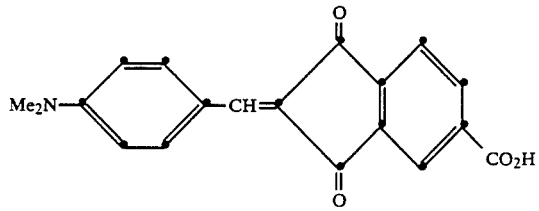

(1)

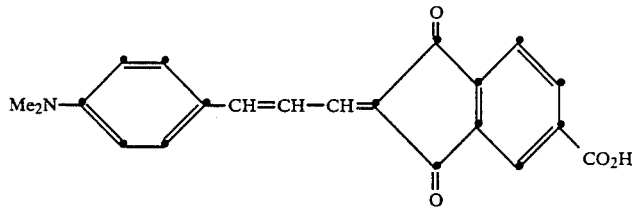

(2)

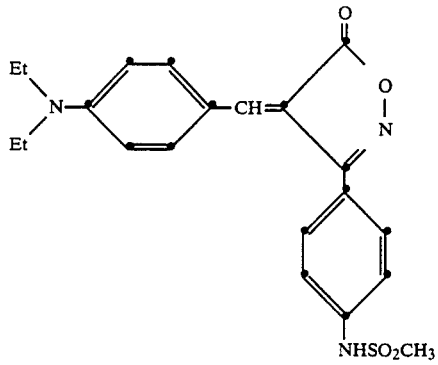

(3)

-continued
(4)
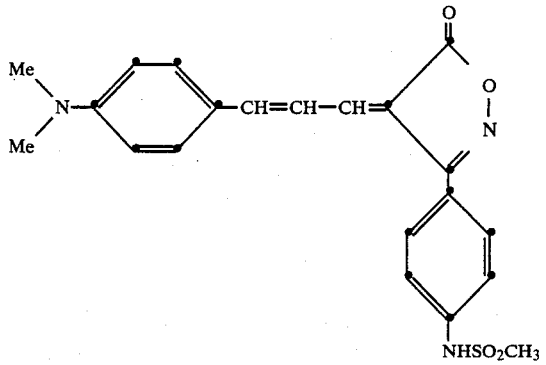
(5)
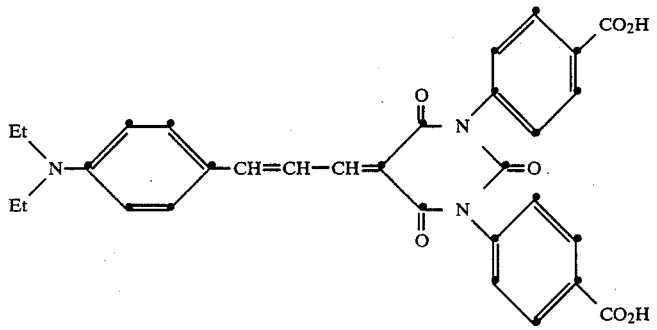
(6)
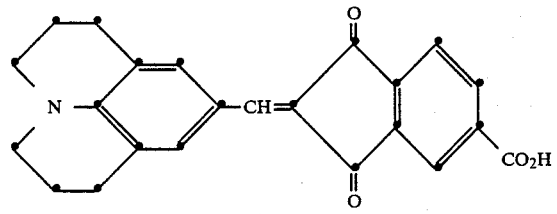
(7)
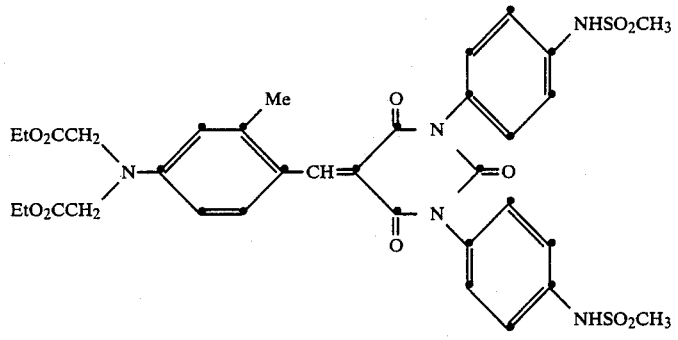
(8)
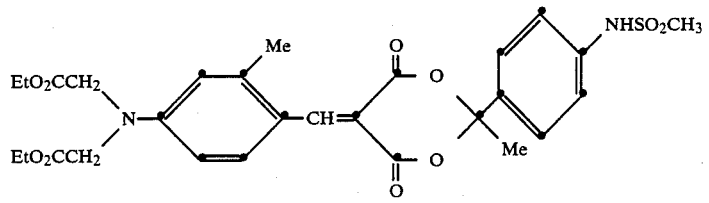

-continued
(9)
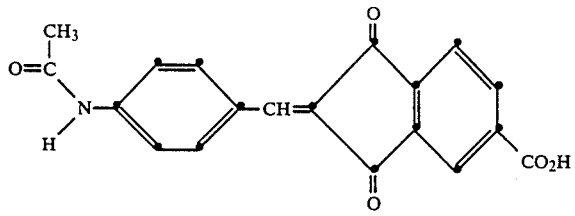
(10)
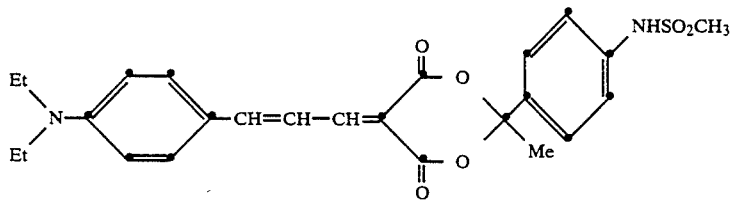
(11)
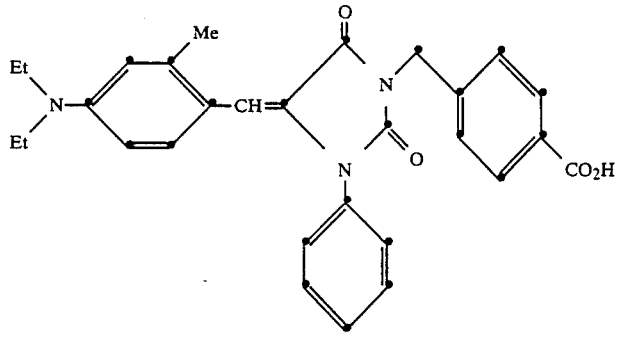
(12)
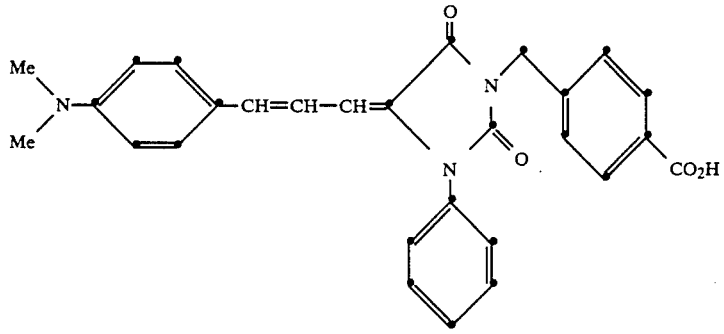
(13)
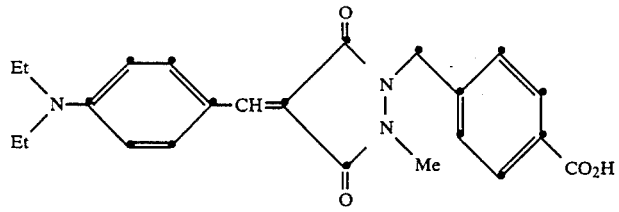
(14)
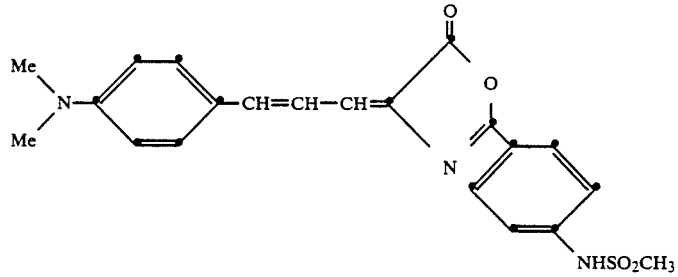

-continued
(15)
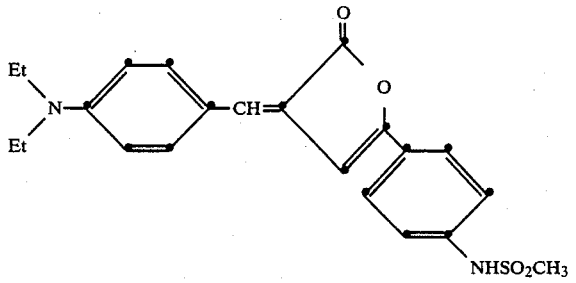
(16)
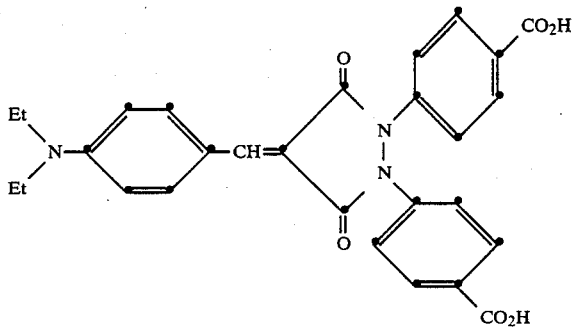
(17)
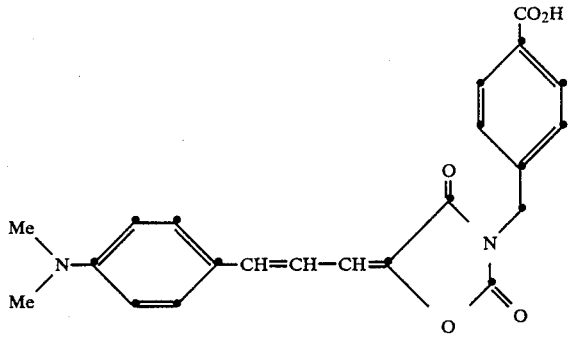
(18)
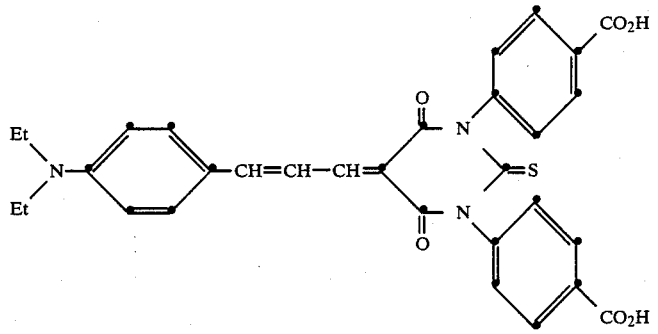
(19)
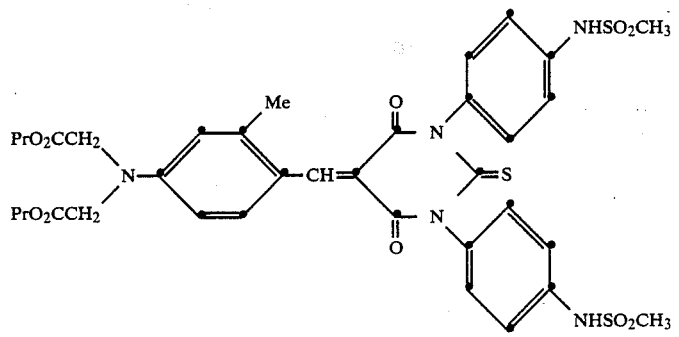

-continued
(20)
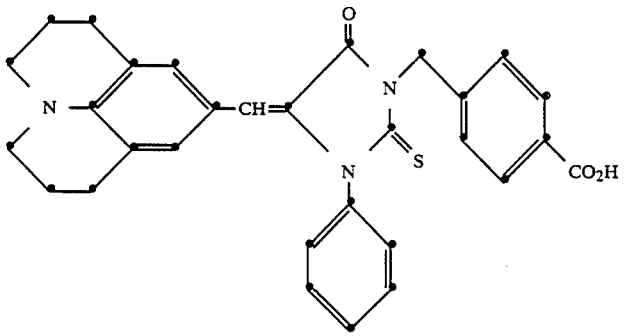
(21)
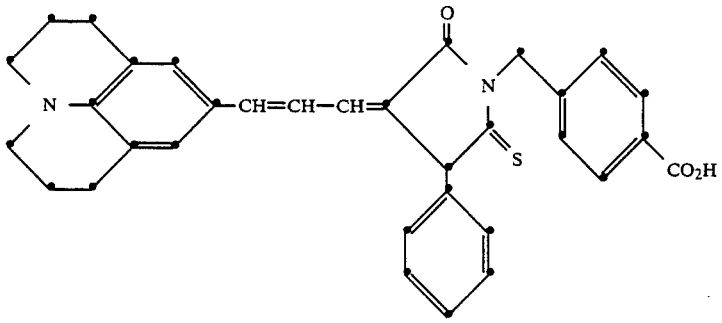
(22)
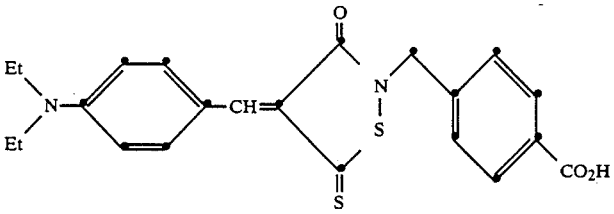
(23)
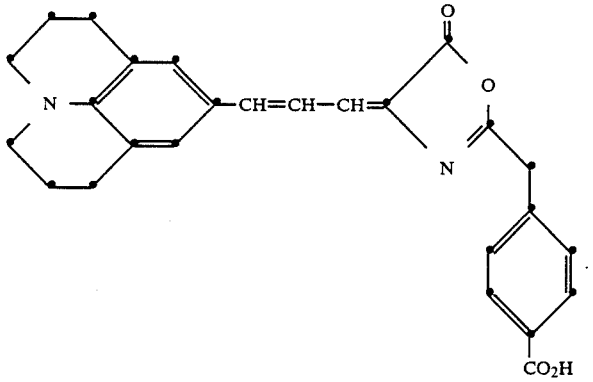
(24)
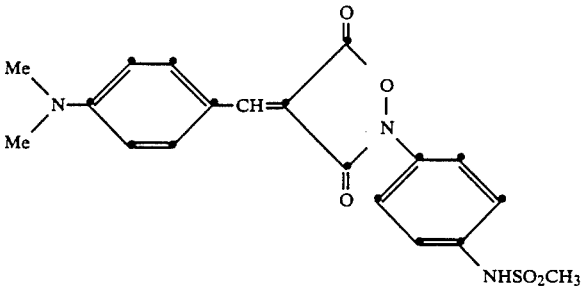

-continued (25)

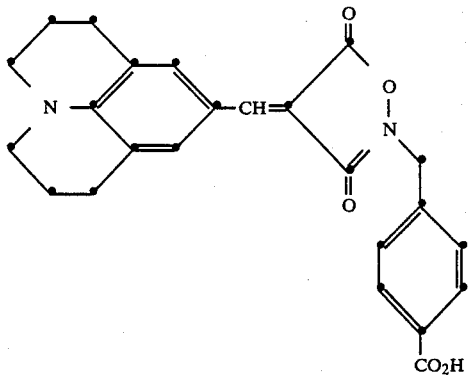

Examples 1–2, infra, relate to the preparation of representative dyes of the invention. Variations on the procedures described to obtain other dyes of this invention are within the skill of the practicing synthetic chemist. Procedures for making such dyes are described in "The Cyanine Dyes and Related Compounds", Frances Hamer, Interscience Publishers, 1984.

EXAMPLE 1

Synthesis of Dye 2

A slurry of 5.2 grams (0.02 mol) 5-carboxyl-2-ethoxycarbonyl-1,3-indandione, 3.5 grams (0.02 mol) 4-dimethylamino-cinnamaldehyde and 100 ml of glacial acetic acid was heated at 130° C. with constant stirring for 30 minutes. The dark purple product mixture was then allowed to cool to room temperature and the precipitated product was collected by filtration and washed with ether. The weight of crude product was 4.72 grams. The crude dye was purified by consecutive slurring in refluxing glacial acetic acid, then twice in refluxing methanol to afford 3.7 grams (57.5% yield) of pure dye 2, m.p.=290°–293° C. All analytical (i.e., infrared spectrum, NMR analysis) data were consistent with the structure.

The dyes of this invention are useful in black and white, single color, multicolor or duplitized® X-ray photographic elements. They can be present in any layer of the element where it is desirable to include a filter dye, for example, in the silver halide emulsion layer or a separate filter layer. The dyes of the invention can be utilized in any amount that is useful to filter or absorb light, but it is particularly advantageous to utilize them in an amount and in a location so that they will be solubilized and washed out during processing. In situations where it is desirable to absorb only a small amount of light, only a small amount of dye is needed. In situations where it is desirable to absorb a larger amount of light, larger amounts of dye can be used, as long as the stain level remains at a level that is acceptable for that particular photographic element. The dye is preferably present in the element of the invention in an amount of from 1 to 100 mg/m$^2$. The dye should be present in an amount sufficient to yield an optical density at the transmission D-max in the visible region before processing of at least 0.10 density units and preferably at least 0.50 density units. This optical density will generally be less than 5.0 density units for most photographic applications.

The dyes of the invention are preferably in the form of a solid particle dispersion for incorporation into a hydrophilic layer comprising a polymer binder such as a hydrophilic colloid layer coated on a photographic element, although some of the dyes can also be incorporated in other ways, such as in the solvent phase of an "oil in water type" dispersion or in loaded polymer latex particles, such as those described in *Research Disclosure,* Item 19551, July, 1980. The solid particle dispersion can be formed by precipitating the dye in the form of a dispersion and/or by well-known milling techniques, e.g., ball-milling or sand-milling the dye in the presence of a dispersing agent. The dye particles in the dispersion preferably have a mean diameter of less than 10 μm and more preferably of less than 1 μm. The dye particles can be conveniently prepared in sizes ranging down to about 0.01 μm or less.

In the following discussion of suitable materials for use in the emulsions and elements of this invention, reference will be made to *Research Disclosure,* December 1978, Item 17643, published by Kenneth Mason Publications, Ltd., The Old Harbourmaster's, 8 North Street, Emsworth, Hampshire P010 7DD, England, the disclosures of which are incorporated herein by reference. This publication will be identified hereafter by the term "Research Disclosure".

The radiation-sensitive layer of the element of the invention can contain any of the known radiation-sensitive materials, such as silver halide, diazo image-forming systems, light-sensitive tellurium-containing compounds, light-sensitive cobalt-containing compounds, and others described in, for example, J. Kosar, Light-Sensitive Systems: Chemistry and Application of Nonsilver Halide Photographic Processes, J. Wiley & Sons, N.Y. (1965). Radiation-sensitive materials exhibiting sensitivity to blue light and especially those sensitive to blue light and at least some other wavelength of radiation are preferred, as the dyes according to the invention can be advantageously used to absorb some or all of the blue light.

Silver halide is especially preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes. Silver halide emulsions and their preparation are further described in *Research Disclosure,* Section I. Also useful are tabular grain silver halide emulsions, as described in *Research Disclosure,* January, 1983, Item 22534 and U.S. Pat. No. 4,425,426.

The radiation-sensitive materials described above can be sensitized to a particular wavelength range of radiation, such as the red, blue, or green portions of the visible spectrum, or to other wavelength ranges, such as ultraviolet, infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, styryls, or other known spectral sensitizers. Additional information on sensitization of silver halide is described in *Research Disclosure,* Sections I–IV.

Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806, issued Dec. 7, 1982.

A typical multicolor photographic element would comprise a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element can contain additional layers, other filter layers, interlayers, overcoat layers, subbing layers, and the like.

In addition to the couplers the elements can include additional couplers as described in *Research Disclosure* Section VII, paragraphs D, E, F and G and the publications cited therein. These couplers can be incorporated in the elements and emulsions as described in *Research Disclosure* Section VII, paragraph C and the publications cited therein.

The photographic elements or individual layers thereof, can contain brighteners (see Research Disclosure Section V), antifoggants and stabilizers (see *Research Disclosure* Section VI), antistain agents and image dye stabilizers (see *Research Disclosure* Section VII, paragraphs I and J), light absorbing and scattering materials (see *Research Disclosure* Section VIII), hardeners (see *Research Disclosure* Section XI), plasticizers and lubricants (see *Research Disclosure* Section XII), antistatic agents (see *Research Disclosure* Section XIII), matting agents (see *Research Disclosure* Section XVI) and development modifiers (see *Research Disclosure* Section XXI).

The photographic elements can be coated on a variety of supports as described in *Research Disclosure* Section XVII and the references described therein.

Photographic elements can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

The dye of formula (I) can be located in any layer of a photographic element where it is desired to absorb light. In preferred embodiment, the dye is preferably located in a layer where it will be subjected to high pH (i.e., 8 to 12) and aqueous sulfite during photographic processing, so as to allow the dye to be solubilized and removed or decolorized.

The photographic elements of the invention, when exposed, can be processed to yield an image. During processing, the dye of formula (I) will generally be decolorized and/or removed. Following processing, the dye of the invention should contribute less than 0.10 density unit, and preferably less than 0.02 density unit to the transmission D-max in the visible region in the minimum density areas of the exposed and processed element.

Processing can be by any type of known photographic processing, as described in Research Disclosure, Sections XIX–XXIV, although it preferably includes a high pH (i.e., 8 or above) step utilizing an aqueous sulfite solution in order to maximize decolorization and removal of the dye. A negative image can be developed by color development with a chromogenic developing agent followed by bleaching and fixing. A positive image can be developed by first developing with a non-chromogenic developer, then uniformly fogging the element, and then developing with a chromogenic developer. If the material does not contain a color-forming coupler compound, dye images can be produced by incorporating a coupler in the developer solutions.

Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium of potassium salts of ferric ethylenediaminetetraacetic acid), water-soluble persulfates (e.g., potassium, sodium, or ammonium persulfate), water-soluble dichromates (e.g., potassium sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

EXAMPLES 3–6

These examples illustrate the use of the dyes of the invention in filter layers of photographic elements.

Procedure for Preparation of the Microcrystalline Dye Dispersions

The dyes were subjected to ball-milling according to the following procedure. Water (21.7 ml) and a 6.7% solution of Triton X-200® (TX-200®) (2.65 gm) (available from Rohm & Haas) were placed in a 60 ml screw-capped bottle. A 1.00 gm sample of dye was added to this solution. Zirconium oxide (ZrO) beads (40 ml) (2 mm diameter) were added and the container with the cap tightly secured was placed in a Sweco® mill and the contents were milled for four days. The container was removed and the contents added to a 12.5% aqueous gelatin (8.0 gm). The new mixture was placed on a roller mill for 10 minutes to reduce foaming and the resulting mixture was then filtered to remove the ZrO beads.

Coating Procedure

A spreading agent, surfactant 10G ® (available from Olin), and a hardener (bis(vinyl-sulfonylmethyl)ether) were added to the dye-gelatin melt prepared as described in the above in the preparation of the solid particle dye dispersions. A melt prepared from the latter mixture was then coated on polyethylene terephthalate support to achieve a dye coverage of 0.32 g/m$^2$, gelatin coverage of 1.60 g/m$^2$, a spreading agent level of 0.096 g/m$^2$ and a hardener level of 0.016 g/m$^2$. The absorbance of the dye dispersions was measured with a spectrophotometer. Identical elements were subjected to a 5-minute distilled water wash, to Kodak D-6 ® processing (which is described in *British Journal of Photography Annual*, 1977, pp. 194–197) and to Kodak Prostar ® processing (which is used commercially to process microfilm, subjecting the elements to a development step at a pH of about 11.4 for 30 seconds), and the absorbance was measured for each. The results are presented in Table I.

TABLE I

| Dye | λ-max (nm) | Bandwidth (nm) | D-max | D-max after water Wash | D-max After E-6 ® Processing | D-max After Prostar ® Processing |
|---|---|---|---|---|---|---|
| 1 | 370 | 17 | 0.74 | 0.70 | 0.01 | 0/01 |
| 2 | 578 | 209 | 1.28 | 1.22 | 0.01 | 0.01 |
| 6 | 507 | 138 | 0.82 | 0.79 | 0.01 | 0.01 |
| 9 | 456 | 121 | 0.81 | 0.77 | 0.01 | 0.01 |

The results presented in Table I show that the dyes 1–3 according to the invention are not affected by the water wash, indicating no wandering at coating pH, but are fully solubilized for removal and/or decolorization by the photographic processing to which they were subjected.

The invention has been described in detail with particular reference to preferred embodiments thereof, but it will be understood that variations and modifications can be effected within the spirit and scope of the invention.

What is claimed is:

1. A photographic element comprising a support, a radiation-sensitive silver halide layer and a hydrophilic filter layer comprising a hydrophilic binder and about 1 to 100 mg/m$^2$ of a dye having the formula:

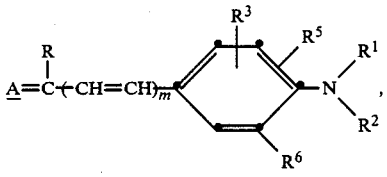

wherein

A represents a substituted or unsubstituted nucleus selected from the group consisting of rhodanines, hydantoins, 2-thiohydantions, 4-thiohydantoins, 2,4-oxazolidindiones, 2-thio-2,4-oxazolidindiones, isoxazolinones, barbiturics, 2-thiobarbiturics, and indandiones, said nucleus having a carboxyphenyl substituent or sulfonamidophenyl substituent, R represents hydrogen, alkyl of 1 to 4 carbon atoms, or benzyl, $R^1$ and $R^2$ each independently represents alkyl or aryl, or taken together with $R^5$, $R^6$, N, and the carbon atoms to which they are attached, represent the atoms needed to complete a julolydyl ring, $R^3$ represents H, alkyl, or aryl, $R^5$ and $R^6$ each independently represents H, or $R^5$ taken together with $R^1$, or $R^6$ taken together with $R^2$, may each represent the atoms necessary to complete a carbocyclic ring, and m is 0 or 1, said dye being in the form of a dispersion of solid particles having a mean diameter of about 0.01 to 10 μm.

2. A photographic element according to claim 1 wherein said filter layer is the same layer as said silver halide emulsion layer.

3. A photographic element according to claim 1 wherein said filter layer is a different layer on the same side of the support as said silver halide emulsion layer.

4. A photographic element according to claim 1 wherein the silver halide layer is on one side of the support, and further comprising a second silver halide radiation-sensitive layer on the other side of the support, and wherein the dye layer is located between one of the silver halide layers and the support.

5. A photographic element according to claim 1 wherein the dye has the formula:

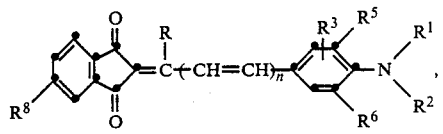

I wherein

R represents hydrogen, alkyl of 1 to 4 carbon atoms or benzyl, $R^1$ and $R^2$, each independently, represents alkyl or aryl, or taken together with $R^5$, $R^6$, N and the carbon atoms to whatever they are attached represent the atoms needed to complete a julolydyl ring, $R^3$ represents H, alkyl, aryl, alkoxy, hydrogen or acetamido, $R^4$ represents alkyl, alkoxycarbonyl, aryl, acyl and amido, $R^5$ and $R^6$ each independently represents H, or $R^5$ taken together with $R^1$, or $R^6$ taken together with $R^2$ represent the atoms necessary to complete a carbocyclic ring, $R^8$ represents $CO_2H$ or $NHSO_2R^9$ wherein $R^9$ is substituted or unsubstituted alkyl or aryl, and n is 0 or 1.

6. A photographic element according claim 5 wherein $R^1$ and $R^2$, each independently represents $CH_3$, $C_2H_5$, n-$C_4H_9$, or i-$C_3H_1OC(=O)CCH_2$, $R^3$ represents H, $CH_3$, or OH, $R^4$ represents $CH_3$, $COOC_2H_5$, or COOH, $R^5$, $R^6$ and $R^7$ each represent H, or $R^5$, $R^6$, $R^1$ and $R^2$, together with the atoms to which they are attached, form a julolydyl ring.

7. A photographic element according to any of claims 1–6 wherein said particles have a mean diameter of about 0.01 to 1.0 μm.

8. A photographic element according to any of claims 1–6 wherein said particles consist essentially of said dye.

9. A photographic element according to claim 8 wherein said particles have a mean diameter of from 0.01 to 1.0 μm.

* * * * *